US012071700B2

(12) United States Patent
Urban et al.

(10) Patent No.: US 12,071,700 B2
(45) Date of Patent: Aug. 27, 2024

(54) ELECTROPLATING WITH A POLYCARBOXYLATE ETHER SUPRESSOR

(71) Applicant: BASF SE, Ludwigshafen (DE)

(72) Inventors: Tobias Urban, Ludwigshafen (DE); Paul Klingelhoefer, Ludwigshafen (DE); Sophie Maitro-Vogel, Ludwigshafen (DE); Yvonne Schriefers, Ludwigshafen (DE); Frank Richter, Ludwigshafen (DE); Manfred Bichler, Trostberg (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 17/909,030

(22) PCT Filed: Mar. 3, 2021

(86) PCT No.: PCT/EP2021/055364
§ 371 (c)(1),
(2) Date: Sep. 2, 2022

(87) PCT Pub. No.: WO2021/175935
PCT Pub. Date: Sep. 10, 2021

(65) Prior Publication Data

US 2023/0091747 A1 Mar. 23, 2023

(30) Foreign Application Priority Data

Mar. 6, 2020 (EP) ..... 20161357
Jun. 9, 2020 (EP) ..... 20179012

(51) Int. Cl.

| | |
|---|---|
| ***C25D 3/02*** | (2006.01) |
| ***C25D 3/38*** | (2006.01) |
| ***C25D 5/00*** | (2006.01) |
| ***C25D 21/12*** | (2006.01) |

(52) U.S. Cl.
CPC ..... *C25D 21/12* (2013.01); *C25D 3/38* (2013.01)

(58) Field of Classification Search
CPC ..... C25D 3/02; C25D 3/38; C25D 5/00
USPC ..... 205/261, 296, 297, 298
See application file for complete search history.

(56) References Cited

U.S. PATENT DOCUMENTS

2008/0017078 A1* 1/2008 Bichler ..... C04B 28/144 106/735
2016/0002472 A1* 1/2016 Bichler ..... C04B 28/06 523/205

FOREIGN PATENT DOCUMENTS

WO 2017/059562 A1 4/2017
WO 2018/114985 A1 6/2018

OTHER PUBLICATIONS

Lei et al. , "Synthesis and Properties of a Vinyl Ether-Based Polycarboxylate Superplasticizer for Concrete Possessing Clay Tolerance," Industrial & Engineering Chemistry Research (Jan. 22, 2014), vol. 53, No. 3, pp. 1048-1055. (Year: 2014).*
International Search Report for PCT Patent Application No. PCT/EP2021/055364, Issued on May 31, 2021, 3 pages.

* cited by examiner

*Primary Examiner* — Edna Wong
(74) *Attorney, Agent, or Firm* — ArentFox Schiff LLP

(57) ABSTRACT

The present invention relates to a process for depositing a metal layer on a substrate by contacting the substrate with a metal plating bath comprising a metal ion source and a suppressor, and applying a current density to the substrate, where the suppressor is a polycarboxylate ether as described below. The invention further relates to a metal plating bath comprising a metal ion source and the suppressor which is a polycarboxylate ether; and to a use of the polycarboxylate ether in a metal plating bath for depositing a metal layer on a substrate.

15 Claims, No Drawings

ELECTROPLATING WITH A POLYCARBOXYLATE ETHER SUPRESSOR

CROSS-REFERENCE TO RELATED APPLICATIONS

This application is a National Stage Entry of PCT/EP2021/055364, filed Mar. 3, 2021, which claims priority to European Application No. 20161357.7, filed Mar. 6, 2020, and EP Application No. 20179012.8, filed Jun. 9, 2020 the disclosures of each of which are hereby incorporated by reference in their entireties.

The present invention relates to a process for depositing a metal layer on a substrate by contacting the substrate with a metal plating bath comprising a metal ion source and a suppressor, and applying a current density to the substrate, where the suppressor is a polycarboxylate ether as described below. The invention further relates to a metal plating bath comprising a metal ion source and the suppressor which is a polycarboxylate ether; and to a use of the polycarboxylate ether in a metal plating bath for depositing a metal layer on a substrate.

Electroplating has several problems which need to be solved: The plating bath should have a high electrochemical stability because additives tend to degrade over time. This is important for an cost-effective electroplating process. The metal layer which is deposited on the substrate should have a smooth and uniform layer thickness, and it should have a high gloss. The electroplating should have good leveling properties, in particular provide substantially planar metal layer and filling features on the nanometer and on the micrometer scale without substantially forming defects.

The object was solved by a process for depositing a metal layer on a substrate by a) contacting the substrate with a metal plating bath comprising a metal ion source and a suppressor, and b) applying a current density to the substrate, where the suppressor is a polycarboxylate ether obtainable by polymerizing a mixture of monomers comprising (I) at least one ethylenically unsaturated monomer (I) which comprises at least one radical from the series carboxylic acid, carboxylic salt, carboxylic ester, carboxylic amide, carboxylic anhydride, and carboxylic imide; and (II) at least one ethylenically unsaturated monomer (II) having a polyalkylene oxide radical.

The object was also solved by a metal plating bath comprising a metal ion source and the suppressor which is a polycarboxylate ether.

The object was also solved by a use of the suppressor which is the polycarboxylate ether in a metal plating bath for depositing a metal layer on a substrate.

The process for depositing the metal layer on the substrate is usually electroplating. Typically, substrates are electroplated by immersing the substrate in the metal plating bath And contacting the substrate as the cathode of the electrical cycle. The metal plating bath contains a counter electrode, the anode, which may be soluble or insoluble. Optionally, cathode and anode may be separated by a membrane.

Sufficient current density is applied and plating performed for a period of time sufficient to deposit a metal layer, such as a copper layer, having a desired thickness on the substrate. Suitable current densities, include, but are not limited to, the range of 0.1 to 25 A/dm$^2$.

The specific current density depends upon the substrate to be plated, the leveling agent selected and the like. Such current density choice is within the abilities of those skilled in the art. The applied current may be a direct current (DC), a pulse current (PC), a pulse reverse current (PRC) or other suitable current.

In general, when the electroplating is used to deposit metal on a substrate, the metal plating baths are agitated during use. Any suitable agitation method may be used with the present invention and such methods are well-known in the art. Suitable agitation methods include, but are not limited to, inert gas or air sparging, work piece agitation, impingement and the like.

Plating equipment are well known. Plating equipment usually comprises an electroplating tank which holds Cu electrolyte and which is made of a suitable material such as plastic or other material inert to the electrolytic plating solution. The anode is typically a soluble anode.

The cathode substrate and anode are electrically connected by wiring and, respectively, to a rectifier (power supply). The cathode substrate for direct or pulse current has a net negative charge so that Cu ions in the solution are reduced at the cathode substrate forming plated Cu metal on the cathode surface. An oxidation reaction takes place at the anode. The cathode and anode may be horizontally or vertically disposed in the tank.

Suitable substrates are any used in the manufacture of decorative or electronic devices. Thus, the metal plating bath can be widely applied for decorative use to functional purpose.

Suitable electronic devices typically contain a number of features, particularly apertures, having a variety of sizes. Particularly suitable substrates are those having apertures on the nanometer and on the micrometer scale. For example, the process is particularly suitable for depositing copper on integrated circuit substrates, such as semiconductor devices, with small diameter vias, trenches or other apertures. In one embodiment, semiconductor devices (e.g. wafers used in the manufacture of integrated circuits) are plated according to the process. As used herein, "feature" refers to the geometries on a substrate, such as, but not limited to, trenches and vias. "Apertures" refer to recessed features, such as vias and trenches.

While the process may be useful in any electrolytic process where an essentially level or planar metal (e.g. copper) deposit is desired (preferably having high reflectivity). Accordingly, suitable substrates include lead frames, interconnects, printed wiring boards, and the like.

Suitable decorative substrates are steel, brass, or plastics.

The metal ion source may be any compound capable of releasing metal ions to be deposited in the electroplating bath in sufficient amount, and which is usually at least partially soluble in the electroplating bath. It is preferred that the metal ion source is soluble in the plating bath. Suitable metal ion sources are metal salts and include metal sulfates, metal halides, metal acetates, metal nitrates, metal fluoroborates, metal alkylsulfonates, metal arylsulfonates, metal sulfamates, metal gluconates and the like.

It is preferred that the metal ion source comprises a copper salt. It is further preferred that the source of metal ions is copper sulfate, copper chloride, copper acetate, copper citrate, copper nitrate, copper fluoroborate, copper methane sulfonate, copper phenyl sulfonate and copper p-toluene sulfonate. Copper sulfate pentahydrate and copper methane sulfonate are particularly preferred. Such metal salts are generally commercially available and may be used without further purification.

Besides metal electroplating the compositions may be used in electroless deposition of metal containing layers.

The compositions may particularly used in the deposition of barrier layers containing Ni, Co, Mo, W and/or Re. In this case, besides metal ions, further elements of groups III and V, particularly B and P may be present in the composition for electroless deposition and thus co-deposited with the metals.

The metal ion source may be used in any amount that provides sufficient metal ions for electroplating on a substrate. Suitable metal ion metal sources include, but are not limited to, tin salts, copper salts, and the like. When the metal is copper, the copper salt is typically present in an amount in the range of from about 1 to about 300 g/l of plating solution. Mixtures of metal salts are also suitable. Thus, alloys, such as copper-tin having up to about 2 percent by weight tin, may be advantageously plated. The amounts of each of the metal salts in such mixtures depend upon the particular alloy to be plated and are well known to those skilled in the art.

The metal plating bath may further include an electrolyte, i. e. acidic or alkaline electrolyte, one or more sources of metal ions, optionally halide ions, and optionally other additives like accelerators and/or suppressors. Such baths are typically aqueous. The water may be present in a wide range of amounts. Any type of water may be used, such as distilled, deionized or tap.

The metal plating bath may be prepared by combining the components in any order. It is preferred that the inorganic components such as metal salts, water, electrolyte and optional halide ion source, are first added to the bath vessel followed by the organic components such as leveling agents, accelerators, suppressors, surfactants and the like.

Typically, the metal plating baths may be used at any temperature from 10 to 65 degrees C. or higher. It is preferred that the temperature of the metal plating baths is from 10 to 35 degrees C. and more preferably from 15 degrees to 30 degrees C.

Suitable electrolytes include sulfuric acid, acetic acid, fluoroboric acid, alkylsulfonic acids such as methanesulfonic acid, ethanesulfonic acid, propanesulfonic acid and trifluoromethane sulfonic acid, arylsulfonic acids such as phenyl sulfonic acid and toluenesulfonic acid, sulfamic acid, hydrochloric acid, phosphoric acid, tetraalkylammonium hydroxide, preferably tetramethylammonium hydroxide, sodium hydroxide, potassium hydroxide and the like. Acids are typically present in an amount in the range of from about 1 to about 300 g/L, alkaline electrolytes are typically present in an amount of about 0.1 to about 20 g/L or to yield a pH of 8 to 13 respectively, and more typically to yield a pH of 9 to 12.

The metal plating bath may optionally further comprise a source of halide ions, such as chloride ions as in copper chloride or hydrochloric acid. A wide range of halide ion concentrations may be used in the present invention such as from about 0 to about 500 mg/l. Typically, the halide ion concentration is in the range of from about 10 to about 100 mg/l based on the plating bath. It is preferred that the electrolyte is sulfuric acid or methanesulfonic acid, and preferably a mixture of sulfuric acid or methanesulfonic acid and a source of chloride ions.

The polycarboxylate ether (also called PCE) are commercially available.

The suppressor is a polycarboxylate ether obtainable by polymerizing a mixture of monomers comprising (I) at least one ethylenically unsaturated monomer (I) which comprises at least one radical from the series carboxylic acid, carboxylic salt, carboxylic ester, carboxylic amide, carboxylic anhydride, and carboxylic imide; and (II) at least one ethylenically unsaturated monomer (II) having a polyalkylene oxide radical.

The PCE comprises at least two monomer units. It may, though, also be advantageous to use copolymers having three or more monomer units.

In one preferred embodiment, the ethylenically unsaturated monomer (I) is represented by at least one of the following general formulae from the group (Ia), (Ib), and (Ic):

(Ia)

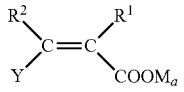

(Ib)

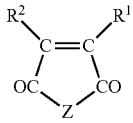

(Ic)

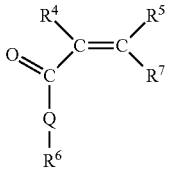

For the monocarboxylic or dicarboxylic acid derivative (Ia) and for the monomer (Ib) in cyclic form, where Z represents O (acid anhydride) or $NR^2$ (acid imide), $R^1$ and $R^2$ independently of one another are hydrogen or an aliphatic hydrocarbon radical having 1 to 20 C atoms, preferably a methyl group. Y is H, —$COOM_a$, —CO—$O(C_qH_{2q}O)_r$—$R^3$, or —CO—NH—$(C_qH_{2q}O)_r$—$R^3$.

M is hydrogen, a monovalent or divalent metal cation, preferably sodium, potassium, calcium, or magnesium ion, additionally ammonium or an organic amine radical, and a=½ or 1, according to whether M is a monovalent or a divalent cation. Organic amine radicals used are preferably substituted ammonium groups deriving from primary, secondary, or tertiary $C_{1-20}$ alkylamines, $C_{1-20}$ alkanolamines, $C_{5-8}$ cycloalkylamines, and $C_{6-14}$ arylamines. Examples of the amines in question are methylamine, dimethylamine, trimethylamine, ethanolamine, diethanolamine, triethanolamine, methyldiethanolamine, cyclohexylamine, dicyclohexylamine, phenylamine, and diphenylamine in the protonated (ammonium) form.

$R^3$ is hydrogen, an aliphatic hydrocarbon radical having 1 to 20 C atoms, a cycloaliphatic hydrocarbon radical having 5 to 8 C atoms, an aryl radical having 6 to 14 C atoms, it being possible optionally for this radical to be substituted, q=2, 3, or 4, and r=0 to 200, preferably 1 to 150. The aliphatic hydrocarbons here may be linear or branched and also saturated or unsaturated. Preferred cycloalkyl radicals are considered to be cyclopentyl or cyclohexyl radicals, and preferred aryl radicals are considered to be phenyl or naphthyl radicals, which in particular may also be substituted by hydroxyl, carboxyl, or sulfonic acid groups.

$R^4$ and $R^5$ independently of one another are hydrogen or an aliphatic hydrocarbon radical having 1 to 20 C atoms, a cycloaliphatic hydrocarbon radical having 5 to 8 C atoms, or an optionally substituted aryl radical having 6 to 14 C atoms. Q may be identical or different and is represented by NH, $NR^3$, or O, with $R^3$ possessing the definition stated above.

Furthermore, $R^6$ is identical or different and is represented by $(C_nH_{2n})$—$SO_3H$ with n=0, 1, 2, 3, or 4, $(C_nH_{2n})$—OH with n=0, 1, 2, 3, or 4; $(C_nH_{2n})$—$PO_3H_2$ with n=0, 1, 2, 3, or 4, $(C_nH_{2n})$—$OPO_3H_2$ with n=0, 1, 2, 3, or 4, $(C_6H_4)$—$SO_3H$, $(C_6H_4)$—$PO_3H_2$, $(C_6H_4)$—$OPO_3H_2$, and $(C_nH_{2n})$—$NR^8{}_b$ with n=0, 1, 2, 3, or 4 and b=2 or 3.

$R^7$ is H, —$COOM_a$, —CO—$O(C_qH_{2q}O)_r$—$R^3$, or —CO—NH—$(C_qH_{2q}O)_r$—$R^3$, where $M_a$, $R^3$, q, and r possess the definitions stated above.

$R^8$ is hydrogen, an aliphatic hydrocarbon radical having 1 to 10 C atoms, a cycloaliphatic hydrocarbon radical having 5 to 8 C atoms, or an optionally substituted aryl radical having 6 to 14 C atoms.

In another preferred form the ethylenically unsaturated monomer (I) is represented by at least one of the following general formulae from the group (Ia), (Ib), and (Ic)

(Ia)

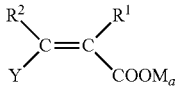

(Ib)

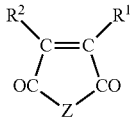

where $R^1$ and $R^2$ independently of one another are hydrogen or an aliphatic hydrocarbon radical having 1 to 20 C atoms, Y is H, —$COOM_a$, —CO—$O(C_qH_{2q}O)_r$—$R^3$, or —CO—NH—$(C_qH_{2q}O)_r$—$R^3$, M is hydrogen, a mono- or divalent metal cation, ammonium ion, or an organic amine radical, a is ½ or 1, $R^3$ is hydrogen, an aliphatic hydrocarbon radical having 1 to 20 C atoms, a cycloaliphatic hydrocarbon radical having 5 to 8 C atoms, or an optionally substituted aryl radical having 6 to 14 C atoms, q independently at each occurrence for each $(C_qH_{2q}O)$ unit is identical or different and is 2, 3, or 4, r is 0 to 200, and Z is O or $NR^3$, (Ic)

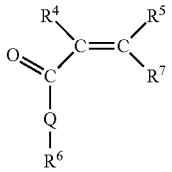

where $R^4$ and $R^5$ independently of one another are hydrogen or an aliphatic hydrocarbon radical having 1 to 20 C atoms, a cycloaliphatic hydrocarbon radical having 5 to 8 C atoms, or an optionally substituted aryl radical having 6 to 14 C atoms, Q is identical or different and is represented by NH, $NR^3$, or O, where $R^3$ possesses the definition stated above, $R^6$ is identical or different and is represented by $(C_nH_{2n})$—$SO_3H$ with n=0, 1, 2, 3, or 4, $(C_nH_{2n})$—OH with n=0, 1, 2, 3, or 4; $(C_nH_{2n})$—$PO_3H_2$ with n=0, 1, 2, 3, or 4, $(C_nH_{2n})$—$OPO_3H_2$ with n=0, 1, 2, 3, or 4, $(C_6H_4)$—$SO_3H$, $(C_6H_4)$—$PO_3H_2$, $(C_6H_4)$—$OPO_3H_2$, and $(C_nH_{2n})$—$NR^8{}_b$ with n=0, 1, 2, 3, or 4 and b=2 or 3, $R^7$ is H, —$COOM_a$, —CO—$O(C_qH_{2q}O)_r$—$R^3$, —CO—NH—$(C_qH_{2q}O)_r$—$R^3$, where $M_a$, $R^3$, q, and r possess definitions stated above, and $R^8$ is hydrogen, an aliphatic hydrocarbon radical having 1 to 10 C atoms, a cycloaliphatic hydrocarbon radical having 5 to 8 C atoms, or an optionally substituted aryl radical having 6 to 14 C atoms.

Suitable examples for ethylenically unsaturated monomer (I) are salts of (meth)acrylic acid, salts of itaconic acid, methacrylic anhydride, maleic anhydride, fumaric anhydride, itaconic anhydride.

In a preferred form the ethylenically unsaturated monomer (I) comprises at least one radical from the series carboxylic acid, carboxylic salt, and carboxylic amide.

In another preferred form the ethylenically unsaturated monomer (I) is a carboxylic salt, a carboxylic acid, or a carboxylic anhydride. In another preferred form the ethylenically unsaturated monomer (I) is a salt of (meth)acrylic acid.

In another preferred form the ethylenically unsaturated monomer (I) is a carboxylic amide, such as N,N-dimethylacrylamide, N,N-dimethylmetacrylamide, N,N-diethylacrylamide, or N,N-diethylmethacrylamide. In another preferred form the ethylenically unsaturated monomer (I) is N,N-dimethylacrylamide.

In one preferred form the ethylenically unsaturated monomer (II) is represented by the following general formula:

(II)

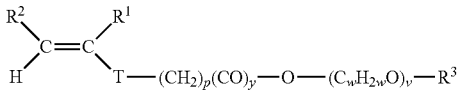

where p is an integer between 0 and 6, y is 0 or 1, v is an integer between 3 and 500, and w independently at each occurrence for each $(C_wH_{2w}O)$ unit is identical or different and is an integer between 2 and 18, and also T is oxygen or a chemical bond. $R^1$, $R^2$, and $R^3$ possess the definition stated above.

In a preferred form of monomer (II) $R^3$ is an aliphatic hydrocarbon radical having 1 to 20 C atoms, preferably methyl, ethyl, propyl or butyl.

In one preferred embodiment, in the general formula (II), p is an integer between 0 and 4, v is an integer between 5 and 250, and w independently at each occurrence for each $(C_wH_{2w}O)$ unit is identical or different and is 2 or 3.

In one particularly preferred embodiment, in the general formula (II), p is 4, v is an integer between 10 and 120, and w independently at each occurrence for each $(C_wH_{2w}O)$ unit is identical or different and is 2 or 3, T is oxygen, and y is 0. In this case it is particularly preferred for at least one subregion to be formed by a random ethylene oxide/propylene oxide copolymer and for the molar fraction of propylene oxide units to be preferably 10 to 30 mol %, based on the sum of the ethylene oxide units and propylene oxide units in the random ethylene oxide/propylene oxide copolymer or in the corresponding subregion.

More particularly the at least one ethylenically unsaturated monomer having a polyalkylene oxide radical (II) may be a compound of the formula (III). The block A consists of a polyethylene oxide unit, with n preferably representing a number from 20 to 30. The block B consists of a random ethylene oxide/propylene oxide copolymer unit, with k preferably representing a number from 5 to 10 and I preferably representing a number from 20 to 35.

(III)

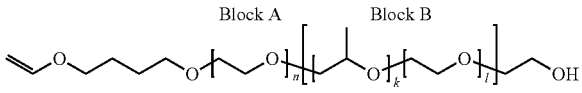

In a further-preferred embodiment of the invention, the ethylenically unsaturated monomer (II) comprises at least one compound of the general formulae (IV), (V), (VI), and (VII), (IV)

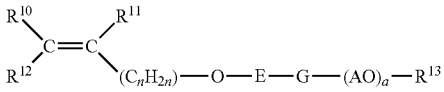

where $R^{10}$, $R^{11}$, and $R^{12}$ are each identical or different and independently of one another are represented by H and/or an unbranched or branched $C_1$-$C_4$ alkyl group, preferably H and/or $CH_3$;

E is identical or different and is represented by an unbranched or branched $C_1$-$C_6$ alkylene group, more particularly $C_1$, $C_2$, $C_3$, $C_4$, $C_5$, or $C_6$, admittedly in each case typically, but preferably $C_2$ and $C_4$, a cyclohexyl group, $CH_2$—$C_6H_{10}$, $C_6H_4$ present in ortho, meta, or para substituted form, and/or an absent unit, i.e., E is not present;

G is identical or different and is represented by O, NH and/or CO—NH, with the proviso that if E is an absent unit, G is also an absent unit, i.e., G is not present;

A is identical or different and is represented by $C_xH_{2x}$, with x=2, 3, 4, and/or 5, preferably x=2, and/or $CH_2CH(C_6H_5)$;

n is identical or different and is represented by 0, 1, 2, 3, 4 and/or 5;

a is identical or different and is represented by an integer from 2 to 350, preferably 10-200;

$R^{13}$ is identical or different and is represented by H, an unbranched or branched $C_1$-$C_4$ alkyl group, CO—$NH_2$, and/or $COCH_3$, preferably H or $CH_3$;

(V)

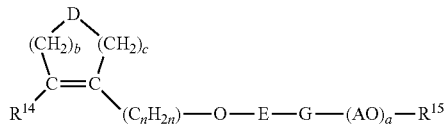

where $R^{14}$ is identical or different and is represented by H and/or an unbranched or branched $C_1$-$C_4$ alkyl group, preferably H;

E is identical or different and is represented by an unbranched or branched $C_1$-$C_6$ alkylene group, preferably $C_2H_4$, a cyclohexyl group, $CH_2$-$C_6H_{10}$, $C_6H_4$ present in ortho, meta, or para substituted form, and/or by an absent unit, i.e., E is not present;

G is identical or different and is represented by an absent unit, O, NH and/or CO—NH, with the proviso that if E is an absent unit, G is also an absent unit, i.e., G is not present;

A is identical or different and is represented by $C_xH_{2x}$ with x=2, 3, 4, and/or 5, preferably x=2, and/or $CH_2CH(C_6H_5)$;

n is identical or different and is represented by 0, 1, 2, 3, 4 and/or 5;

a is identical or different and is represented by an integer from 2 to 350, preferably 10-200;

D is identical or different and is represented by an absent unit, i.e., D is not present, or by NH and/or O, with the proviso that if D is an absent unit: b=0, 1, 2, 3, or 4 and also c=0, 1, 2, 3, or 4, with b+c=3 or 4, and with the proviso that if D is NH and/or O: b=0, 1, 2, or 3, c=0, 1, 2, or 3, and b+c=2 or 3;

$R^{15}$ is identical or different and is represented by H, an unbranched or branched $C_1$-$C_4$ alkyl group, CO—$NH_2$, and/or $COCH_3$, preferably H;

(VI)

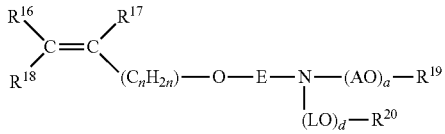

where $R^{16}$, $R^{17}$, and $R^{18}$ are each identical or different and independently of one another are represented by H and/or an unbranched or branched $C_1$-$C_4$ alkyl group, preferably H and/or $CH_3$;

E is identical or different and is represented by an unbranched or branched $C_1$-$C_6$ alkylene group, preferably $C_2H_4$ or $C_4H_8$, a cyclohexyl group, $CH_2$—$C_6H_{10}$, $C_6H_4$ present in ortho, meta, or para substituted form, and/or by an absent unit, i.e., E is not present;

A is identical or different and is represented by $C_xH_{2x}$ with x=2, 3, 4 and/or 5, preferably x=2, and/or $CH_2CH(C_6H_5)$;

n is identical or different and is represented by 0, 1, 2, 3, 4 and/or 5;

L is identical or different and is represented by $C_xH_{2x}$ with x=2, 3, 4 and/or 5, preferably x=2, and/or $CH_2$—CH ($C_6$—$H_5$);

a is identical or different and is represented by an integer from 2 to 350, preferably 10-200;

d is identical or different and is represented by an integer from 1 to 350, preferably 10-200;

$R^{19}$ is identical or different and is represented by H and/or an unbranched or branched $C_1$-$C_4$ alkyl group, preferably H, $R^{20}$ is identical or different and is represented by H and/or an unbranched $C_1$-$C_4$ alkyl group, preferably H.

(VII)

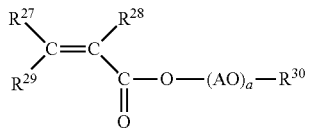

in which $R^{27}$, $R^{28}$, and $R^{29}$ are identical or different and independently of one another are H and/or an unbranched or branched $C_1$-$C_4$ alkyl radical;

A are identical or different and denote $C_xH_{2x}$ with x=2, 3, 4 and/or 5 and/or $CH_2CH(C_6H_5)$;

a are identical or different and are an integer between 2 and 350;

$R^{30}$ are identical or different and are H and/or an unbranched or branched $C_1$-$C_4$ alkyl radical.

Generally it can be said that the polyalkoxy side chains $(AO)_a$ of the polyether macromonomers are very preferably pure polyethoxy side chains, although there may preferably also be mixed polyalkoxy side chains present, more particularly those which contain both propoxy groups and ethoxy groups.

In practice the polyether macromonomer frequently used is alkoxylated isoprenol, i.e., alkoxylated 3-methyl-3-buten-1-ol, and/or alkoxylated hydroxybutyl vinyl ether and/or alkoxylated (meth)allyl alcohol, with allyl alcohol being preferred over methallyl alcohol, having normally in each case an arithmetically mean number of oxyalkylene groups of 4 to 350. Particularly preferred is alkoxylated hydroxybutyl vinyl ether.

It is considered preferable here for the monomer (II) to have a molecular weight of 500 to 10 000 g/mol. In another form monomer (II) has a molecular weight of 500 to 6000 g/mol, preferably 800 to 5000 g/mol, and in particular 1000 to 4000 g/mol. In another form monomer (II) has a molecular weight of at least 500, 700, 900, 1000, 1500, 2000, 2500, or 3000 g/mol. In another form monomer (II) has a molecular weight of up to 8000, 7000, 6000, 5000 or 4000 g/mol. The molecular weight of monomer (II) can be determined by OH-number of the underlying polyalkylene glycol.

Besides the monomers (I) and (II) there may also be further types of monomer employed in the copolymer of the invention. In one particularly preferred embodiment, however, the copolymer of the invention comprises no styrene or derivatives of styrene as monomers.

The molar fraction of the monomers (I) and (II) in the copolymer of the invention may be selected freely within wide ranges. The fraction of the monomer (I) in the polycarboxylate ether is usually 5 to 95 mol %, preferably 30 to 95 mol %, and particularly 55 to 95 mol %.

The fraction of the monomer (II) in the polycarboxylate ether is usually 1 to 89 mol %, preferably 1 to 55 mol %, and particularly 1 to 30 mol %.

The molar ratio of monomers (II) to monomer (I) may be in the range from 1:1 to 1:10, preferably from 1:2 to 1:6.

The weight ratio of monomers (II) to monomer (I) may be in the range from 37/63 to 98/2, preferably from 39/61 to 97/3, more preferably from 45/55 to 96/4, in particular from 48/52 to 95/5.

The polycarboxylate ether may have a molecular weight of 1 000 to 100 000 g/mol, preferably 12 000 to 75 000 determined by gel permeation chromatography against polyethylene glycol standards. In anther form the polycarboxylate ether may have a molecular weight Mw of 5 000 to 60 000, preferably of 15 000 to 40 000 g/mol, e.g. determined by gel permeation chromatography against polyethylene glycol standards The polycarboxylate ether may have a charge density of 0.5 to 5.0, preferably from 0.9 to 3.0, and in particular from 1.1 to 2.0. The charge density can be determined by conductometric titration.

Water is a particularly suitable solvent when preparing the polycarboxylate ether. It is, though, also possible to use a mixture of water and an organic solvent, in which case the solvent ought to be very largely inert in its behaviour with respect to radical polymerization reactions. With regard to the organic solvents, the organic solvents already identified above, in particular, are considered to be particularly suitable.

The polymerization reaction takes place preferably in the temperature range between 0 and 180° C., more preferably between 10 and 100° C., and also under atmospheric pressure or under elevated or reduced pressure. The polymerization may optionally also be performed under an inert gas atmosphere, preferably under nitrogen.

To initiate the polymerization it is possible to use high-energy electromagnetic radiation, mechanical energy, or chemical polymerization initiators such as organic peroxides, examples being benzoyl peroxide, tert-butyl hydroperoxide, methyl ethyl ketone peroxide, cumoyl peroxide, dilauroyl peroxide, or azo initiators, such as azodiisobutyronitrile, azobisamidopropyl hydrochloride, and 2,2'-azobis (2-methylbutyronitrile), for example. Likewise suitable are inorganic peroxy compounds, such as ammonium peroxodisulfate, potassium peroxodisulfate, or hydrogen peroxide, for example, optionally in combination with reducing agents (e.g., sodium hydrogensulfite, ascorbic acid, iron(II) sulfate) or redox systems, which as reducing component comprise an aliphatic or aromatic sulfonic acid (e.g., benzenesulfonic acid, toluenesulfonic acid). Particular preference is given to a mixture of at least one sulfinic acid with at least one iron(III) salt, and/or a mixture of ascorbic acid with at least one iron(III) salt.

Chain transfer agents used, which regulate the molecular weight, are the customary compounds. Suitable known such agents are, for example, alcohols, such as methanol, ethanol, propanol, isopropanol, n-butanol, sec-butanol, and amyl alcohols, aldehydes, ketones, alkylthiols, such as dodecylthiol and tert-dodecylthiol, for example, thioglycolic acid, isooctyl thioglycolate, 2-mercaptoethanol, 2-mercaptopropionic acid, 3-mercaptopropionic acid, and some halogen compounds, such as carbon tetrachloride, chloroform, and methylene chloride, for example.

The polycarboxylate ether may also be prepared by polymer-analogous reactions. In such cases, a polymer which contains latent or free carboxyl groups is reacted with one or more compounds which contain amine or hydroxyl functions, under conditions which lead to partial amidation or esterification of the carboxyl groups, respectively.

The polycarboxylate ether is typically present in an amount in the range of from 1 to 10 000 mg/l, preferably from 500 to 5 000 mg/l based on the weight of the bath. In another form the polycarboxylate ether is typically present in an amount in the range of from 10 to 5 000 mg/l, from 20 to 1 000 mg/l, or from 20 to 200 mg/l.

The metal plating bath may include one or more optional additives. The metal baths may contain one or more of accelerators, further suppressors, leveling agents, sources of halide ions, grain refiners and mixtures thereof.

Suitable accelerators are organic additive that increase the plating rate of the metal plating bath, such as compounds comprising one or more sulphur atom and a sulfonic/phosphonic acid or their salts.

The preferred accelerators have the general structure $M^AO_3X^A—R^{A1}—(S)_a—R^{A2}$, with:

$M^A$ is a hydrogen or an alkali metal (preferably Na or K)

$X^A$ is P or S a=1 to 6

$R^{A1}$ is selected from C1-C8 alkyl group or heteroalkyl group, an aryl group or a heteroaromatic group. Heteroalkyl groups will have one or more heteroatom (N, S, O) and 1-12 carbons. Carbocyclic aryl groups are typical aryl groups, such as phenyl, napthyl. Heteroaromatic groups are also suitable aryl groups and contain one or more N, O or S atom and 1-3 separate or fused rings.

$R^{A2}$ is selected from H or (—S—$R^{A1'}XO_3M$), with $R^{A1'}$ being identical or different from $R^{A1}$.

More specifically, useful accelerators include those of the following formulae:

$$X^AO_3S—R^{A1}—SH$$

$$X^AO_3S—R^{A1}—S—S—R^{A1'}—SO_3X^A$$

$$X^AO_3S—Ar—S—S—Ar—SO_3X^A$$

with $R^{A1}$ as defined above and Ar is Aryl.

Particularly preferred accelerating agents are:

SPS: bis-(3-sulfopropyl)-disulfide disodium salt

MPS: 3-mercapto-1-propansulfonic acid, sodium salt

Other examples of accelerators, used alone or in mixture, include, but are not limited to: MES (2-Mercaptoethanesulfonic acid, sodium salt); DPS (N,N-dimethyldithiocarbamic acid (3-sulfopropylester), sodium salt); UPS (3-[(amino-iminomethyl)-thio]-1-propylsulfonic acid); ZPS (3-(2-benzthiazolylthio)-1-propanesulfonic acid, sodium salt); 3-mercapto-propylsulfonicacid-(3-sulfopropyl)ester; methyl-(ω-sulphopropyl)-disulfide, disodium salt; methyl-(ω-sulphopropyl)-trisulfide, disodium salt.

Such accelerators are typically used in an amount of about 0.1 to about 3000 mg/l, based on the total weight of the plating bath. Particularly suitable amounts of accelerator are 1 to 500 mg/l, and more particularly 2 to 100 mg/l.

Suitable leveling agents include one or more of polyalkanolamine and derivatives thereof, polyethylene imine and derivatives thereof, quaternized polyethylene imine, polyglycine, poly(allylamine), polyaniline, polyurea, polyacrylamide, poly(melamine-co-formaldehyde), reaction products of amines with epichlorohydrin, reaction products of an amine, epichlorohydrin, and polyalkylene oxide, reaction products of an amine with a polyepoxide, polyvinylpyridine, polyvinylimidazole, polyvinylpyrrolidone, or copolymers thereof, nigrosines, pentamethyl-para-rosaniline hydrohalide, hexamethyl-pararosaniline hydrohalide, or compounds containing a functional group of the formula N—R—S, where R is a substituted alkyl, unsubstituted alkyl, substituted aryl or unsubstituted aryl. Typically, the alkyl groups are $(C_1-C_6)$alkyl and preferably $(C_1-C_4)$alkyl. In general, the aryl groups include $(C_6-C_{20})$aryl, preferably $(C_6-C_{10})$aryl. Such aryl groups may further include heteroatoms, such as sulfur, nitrogen and oxygen. It is preferred that the aryl group is phenyl or napthyl. The compounds containing a functional group of the formula N—R—S are generally known, are generally commercially available and may be used without further purification.

In such compounds containing the N—R—S functional group, the sulfur ("S") and/or the nitrogen ("N") may be attached to such compounds with single or double bonds. When the sulfur is attached to such compounds with a single bond, the sulfur will have another substituent group, such as but not limited to hydrogen, $(C_1-C_{12})$alkyl, $(C_2-C_{12})$alkenyl, $(C_6-C_{20})$aryl, $(C_1-C_{12})$alkylthio, $(C_2-C_{12})$alkenylthio, $(C_6-C_{20})$arylthio and the like. Likewise, the nitrogen will have one or more substituent groups, such as but not limited to hydrogen, $(C_1$-C12)alkyl, $(C_2-C_{12})$alkenyl, $(C_7-C_{10})$aryl, and the like. The N—R—S functional group may be acyclic or cyclic. Compounds containing cyclic N—R—S functional groups include those having either the nitrogen or the sulfur or both the nitrogen and the sulfur within the ring system.

In general, the total amount of leveling agents in the electroplating bath is from 0.5 to 10000 mg/l based on the total weight of the plating bath. The leveling agents are typically used in a total amount of from about 0.1 to about 1000 mg/l based on the total weight of the plating bath and more typically from 1 to 100 mg/l, although greater or lesser amounts may be used.

All percent, ppm or comparable values refer to the weight with respect to the total weight of the respective composition except where otherwise indicated.

In addition to the polycarboxylate ether suppressor according to the invention a further suppressor can be used. Suitable further suppressors include polyethylene glycol copolymers, particularly polyethylene glycol polypropylene glycol copolymers. The arrangement of ethylene oxide and propylene oxide of suitable suppressors may be block, gradient, or random. The polyalkylene glycol may comprise further alkylene oxide building blocks such as butylene oxide. Preferably, the average molecular weight of suitable suppressors exceeds about 2000 g/mol. The starting molecules of suitable polyalkylene glycol may be alkyl alcohols such as methanol, ethanol, propanol, n-butanol and the like, aryl alcohols such as phenols and bisphenols, alkaryl alcohols such as benzyl alcohol, polyol starters such as glycol, glycerin, trimethylol propane, pentaerythritol, sorbitol, carbohydrates such as saccharose, and the like, amines and oligoamines such as alkyl amines, aryl amines such as aniline, triethanol amine, ethylene diamine, and the like, amides, lactams, heterocyclic amines such as imidazol and carboxylic acids. Optionally, polyalkylene glycol suppressors may be functionalized by ionic groups such as sulfate, sulfonate, ammonium, and the like.

When a further suppressor is used, is typically present in an amount in the range of from 1 to 10 000 mg/l, preferably from 500 to 5 000 mg/l based on the weight of the bath.

EXAMPLES

Suppressors:

PCE-1: Polycarboxylate ether based on acrylic acid and 4-hydroxybutyl vinyl ether-polyethylene glycol HBVE-PEG (mol weight of polyethylene glycol side chain 3000 g/mol), ratio acrylic acid to HBVE-PEG is 1:2.7, total mol weight Mw=36200 g/mol, Mn 3350 g/mol.

PCE-2: Polycarboxylate ether based on acrylic acid and HBVE-PEG (mol weight of polyethylene glycol side chain 1100 g/mol), charge density 1.61, total mol weight Mw=19290 g/mol.

PCE-3: Polycarboxylate ether based on N,N-dimethylacrylamide and HBVE-PEG (mol weight of polyethylene glycol side chain 3000 g/mol), weight ratio N,N-dimethylacrylamid to HBVE-PEG is 5:1, charge density 1.4 mmol/g, total mol weight Mw=39000 g/mol.

The mol weight of the polycarboxylate ether was determined by GPC (against Na-PAA standard). The charge density was determined by conductometric titration.

Example 1—Deposition Quality of the Metal Layer

An acidic copper plating bath was prepared which contained $CuSO_4$*5 $H_2O$ 200 g/l $H_2SO_4$ (95%) 70 g/l NaCl 100 mg/l Wetting agent 80 mg/l (Plurafac® LF 1430 from BASF, alkoxylated fatty alcohol)

Accelerator 8 mg/l (SPS bis-(3-sulfopropyl)-disulfide disodium salt)

Leveler 24 mg/l (Lugalvan® IZE, BASF, product from imidazole and epichlorhydrin)

The amount of polycarboxylate ether suppressor PCE-1, PCE-2 and PCE-3 was 40 mg/l.

The suppressor candidates were tested according to initial plating performance in the Hull cell (2 A, 10 min, 30° C. on polished brass panel). The panels were evaluated visually with the following rating 1 to 10 (deposition quality, gloss and leveling: 1=not sufficient; 10=perfect) and the results are summarized in Table 1.

The areas on the panel with different current density are termed:

HCD=High current density

MCD=middle current density

LCD=Low current density

The concentrations of each ingredient are 50% lower than in standard industrial application in order to see the effect of the suppressor more clearly. The results demonstrated that the polycarboxylate ethers result in a good deposition quality.

TABLE 1

| Suppressor | Deposition Quality | Appearance from area of HCD to LCD |
|---|---|---|
| PCE-1 | 5-6 | HCD: gloss<br>MCD: gloss<br>LCD: semi-gloss |
| PCE-2 | 5-6 | HCD: gloss<br>MCD: gloss<br>LCD: semi-gloss |
| PCE-3 | 5-6 | HCD: gloss<br>MCD: gloss<br>LCD: semi-gloss |

Example 2—Electrochemical Stability of the Plating Bath

The application parameters for electrochemical stability evaluation were as follows: 250 ml of the readily formulated electrolyte as in Example 1 were exposed to 2 A current for 2 hours at 30° C. This stimulates the electrochemical degradation of the organic ingredients in the plating bath.

Afterwards a normal plating in the same electrolyte is performed as in Example 1 (2 A, 10 min, 30° C.). These depositions are evaluated. Afterwards all ingredients a redosed to the desired starting level and again a 10 min deposition is carried out. This shows if the electrolyte is still working (or not) and so the intensity of the failure from the current exposition run is only derived by degradation.

The panels were evaluated visually with the following rating 1 to 10 (1=very bad; 10=excellent) and the results are summarized in Table 2. For comparison a commercial suppressor Pluriol E9000 (polyethylene glycol, mol mass 9000 g/mol) was used instead of the polycarboxylate ethers.

The results demonstrated that the polycarboxylate ethers improve the electrochemical stability of the plating bath.

TABLE 2

| Suppressor | Electrochemical Stability Rating | Appearance from area of HCD to LCD |
|---|---|---|
| Pluriol E9000 (comparative) | 2 | HCD: Dendrites, dark amorpous dull<br>MCD: Dull amourphous<br>LCD: Dull |
| PCE-1 | 5 | HCD: Dendrites, dull<br>MCD: Dull<br>LCD: Dull |
| PCE-2 | 4 | HCD: Dendrites, minimal amourepous, dull<br>MCD: Dull<br>LCD: Dull |

Example 3—Polarisation

Laser drilling of micro vias and subsequent copper filling is a standard manufacturing technique for high density interconnects. Our process for depositing a metal layer can be used in copper electroplating of micro via, where high filling performance of the micro via (typically a cavity with roughly 20 μm diameter, also called a bottom up filling) and a minimal surface thickness are desired. This was evaluated as follows:

The galvanostatic measurement was made on a Gamry potentiostat with the following parameters:

Amount: 700 ml $CuSO_4 \times 5H_2O$: 200 g/l

NaCl: 0.1 g/l (corresponds to 60 mg/L chloride)

$H_2SO_4$: 70 g/l

Suppressor: 80 mg/l

Accelerator Bis-(3-sulfopropyl)-disulfide disodium salt SPS: 8 mg/l

Cathode area: 5,812 $cm^2$

Cathode material: Cu-ETP (E-Cu; 2.0060)

Anode: Platinum

Reference elektrode: Calomel

Elektrolyte movement: Air agitation

The salts of the base electrolyte were added to graduated flask and the measurement started at a given current as given in Table 3. The potential is measured for about 500 sec until constant. The suppressor was added and the resulting potential recorded. After further 200 sec the SPS was added and for further 1000 sec the potential measured. The average values of these potentials are given in Table 3a and 3b.

TABLE 3a

Polarisation at lower current simulating the desired bottom up filling

| Current | Suppressor: Pluriol E9000 (comparative) | Suppressor: PCE-2 |
|---|---|---|
| 2.5 mA | −148 mV | −123 mV |

The results in Table 3a showed that for the bottom up filling the absolute value of the polarisation was reduced, that means there was less slowdown of the electrons. This was desirable to achieve a high filling performance of the micro via.

TABLE 3b

| Polarisation at higher current simulating the unwanted surface electroplating | | |
|---|---|---|
| Current | Suppressor: Pluriol E9000 (comparative) | Suppressor: PCE-2 |
| 10 mA | −102 mV | −110 mV |

The results in Table 3b showed that for the electroplating of the surface the absolute value of the polarisation was increased, that means there was higher slowdown of the electrons. This was desirable to achieve a minimal surface thickness outside the micro via.

The combination of both results, namely a high filling performance of the micro via and a minimal surface thickness, result in an improve leveling of the interconnects.

The invention claimed is:

1. A process for depositing a metal layer on a substrate comprising the steps of:

a) contacting the substrate with a metal plating bath comprising a metal ion source and a suppressor, and b) applying a current density to the substrate, thereby depositing the metal layer on the substrate, wherein the suppressor is a polycarboxylate ether obtained by polymerizing a mixture of monomers to form a copolymer, comprising (i) at least one ethylenically unsaturated monomer (I) which comprises at least one radical from carboxylic acid, carboxylic salt, carboxylic ester, carboxylic amide, carboxylic anhydride, and/or carboxylic imide; and (ii) at least one ethylenically unsaturated monomer (II) having a polyalkylene oxide radical.

2. The process according to claim 1, wherein the at least one ethylenically unsaturated monomer (I) comprises at least one radical from carboxylic acid, carboxylic salt, and/or carboxylic amide.

3. The process according to claim 1, wherein the ethylenically unsaturated monomer (I) is represented by at least one of the following general formulae of (Ia), (Ib), or (Ic)

(Ia)

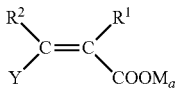

(Ib)

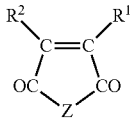

where $R^1$ and $R^2$ independently of one another are hydrogen or an aliphatic hydrocarbon radical having 1 to 20 C atoms, Y is H, —$COOM_a$, —CO—O$(C_qH_{2q}O)_r$—$R^3$, or —CO—NH—$(C_qH_{2q}O)_r$—$R^3$, M is hydrogen, a mono- or divalent metal cation, ammonium ion, or an organic amine radical, a is ½ or 1, $R^3$ is hydrogen, an aliphatic hydrocarbon radical having 1 to 20 C atoms, a cycloaliphatic hydrocarbon radical having 5 to 8 C atoms, or an optionally substituted aryl radical having 6 to 14 C atoms, q independently at each occurrence for each $(C_qH_{2q}O)$ unit is identical or different and is 2, 3, or 4, r is 0 to 200, and Z is O or $NR^3$, (Ic)

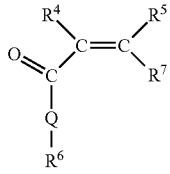

where $R^4$ and $R^5$ independently of one another are hydrogen or an aliphatic hydrocarbon radical having 1 to 20 C atoms, a cycloaliphatic hydrocarbon radical having 5 to 8 C atoms, or an optionally substituted aryl radical having 6 to 14 C atoms, Q is identical or different and is represented by NH, $NR^3$, or O, where $R^3$ possesses the definition stated above, $R^6$ is identical or different and is represented by $(C_nH_{2n})$—$SO_3H$ with n=0, 1, 2, 3, or 4, $(C_nH_{2n})$—OH with n=0, 1, 2, 3, or 4; $(C_nH_{2n})$—$PO_3H_2$ with n=0, 1, 2, 3, or 4, $(C_nH_{2n})$—$OPO_3H_2$ with n=0, 1, 2, 3, or 4, $(C_6H_4)$—$SO_3H$, $(C_6H_4)$—$PO_3H_2$, $(C_6H_4)$—$OPO_3H_2$, and $(C_nH_{2n})$—$NR^8_b$, with n=0, 1, 2, 3, or 4 and b=2 or 3, $R^7$ is H, —$COOM_a$, —CO—O$(C_qH_{2q}O)_r$—$R^3$, —CO—NH—$(C_qH_{2q}O)_r$—$R^3$, where $M_a$, $R^3$, q, and r possess definitions stated above, $R^8$ is hydrogen, an aliphatic hydrocarbon radical having 1 to 10 C atoms, a cycloaliphatic hydrocarbon radical having 5 to 8 C atoms, or an optionally substituted aryl radical having 6 to 14 C atoms.

4. The process according to claim 1, wherein the at least one ethylenically unsaturated monomer (II) is represented by the following general formula (II)

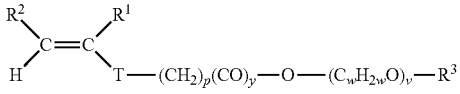

in which

P is an integer between 0 and 6, y is 0 or 1,

V is an integer between 3 and 500,

W independently at each occurrence for each $(C_wH_{2w}O)$ unit is identical or different and is an integer between 2 and 18, T is oxygen or a chemical bond, where $R^1$ and $R^2$ independently of one another are hydrogen or an aliphatic hydrocarbon radical having 1 to 20 C atoms and $R^3$ is hydrogen, an aliphatic hydrocarbon radical having 1 to 20 C atoms, a cycloaliphatic hydrocarbon radical having 5 to 8 C atoms, or an optionally substituted aryl radical having 6 to 14 C atoms.

5. The process according to claim 4, wherein the at least one ethylenically unsaturated monomer (II) p is an integer between 0 and 4, v is an integer between 5 and 250, and w independently at each occurrence for each $(C_wH_{2w}O)$ unit is identical or different and is 2 or 3.

6. The process according to claim 4, wherein the ethylenically unsaturated monomer (II) the $R^3$ is an aliphatic hydrocarbon radical having 1 to 20 C atoms.

7. The process according to claim 1, wherein the at least one ethylenically unsaturated monomer (II) has a molecular weight of 500 to 10 000 g/mol.

8. The process according to claim 1, wherein the polycarboxylate ether has a molecular weight of 1 000 to 100 000 g/mol.

9. The process according to claim 1, wherein a fraction of the at least one ethylenically unsaturated monomer (I) in the copolymer is 5 to 95 mol %.

10. The process according to claim 1, wherein the at least one ethylenically unsaturated monomer (I) is a carboxylic amide.

11. The process according to claim 1, wherein a fraction of the at least one ethylenically unsaturated monomer (II) in the copolymer is 1 to 89 mol %.

12. The process according to claim 1, wherein the polycarboxylate ether is present in the range from 1 to 10 000 mg/l based on the weight of the bath.

13. The process according to claim 1, wherein the metal ion source comprises a copper salt.

14. The process according to claim 1, wherein the metal plating bath further comprises an accelerator which is a compound comprising one or more sulphur atom and a sulfonic/phosphonic acid or their salts.

15. The process according to claim 1, wherein the at least one ethylenically unsaturated monomer (I) is N,N-dimethylacrylamide, N,N-dimethylmetacrylamide, N,N-diethylacryl-amide, or N,N-diethylmethacrylamide.

* * * * *